United States Patent [19]

Snider, Jr.

[11] Patent Number: 4,488,139

[45] Date of Patent: Dec. 11, 1984

[54] ELECTRICAL CONNECTOR

[75] Inventor: Hugh H. Snider, Jr., Silver Spring, Md.

[73] Assignee: The United States of America as represented by the Secretary of the Navy, Washington, D.C.

[21] Appl. No.: 375,241

[22] Filed: May 5, 1982

[51] Int. Cl.[3] ..... H01R 13/648

[52] U.S. Cl. ..... 339/143 R; 339/8 R

[58] Field of Search ..... 339/89 C, 91 B, 143 R, 339/255 R, 10, 15, 8 R, 177 E

[56] References Cited

U.S. PATENT DOCUMENTS 3,046,517 7/1962 Loredo ..... 339/255 R
3,408,610 10/1968 Clarkson ..... 339/8 R
3,517,371 6/1970 Buckley ..... 339/89 C
3,982,060 9/1976 Avery et al. ..... 339/89 C X

FOREIGN PATENT DOCUMENTS 2226332 10/1975 France ..... 339/91 B
2462797 3/1981 France ..... 339/91 B

*Primary Examiner*—Eugene F. Desmond
*Attorney, Agent, or Firm*—Robert F. Beers; Kenneth E. Walden; John C. LaPrade

[57] ABSTRACT

The present invention provides a shielded electrical connector, that has two outer member that may be screw threaded together and they are usually electro conductive, this member is a metallic element combined with an inner insulated member made of a rotatable, soft plastic or rubber material that not only insulates but provides a cushion protective environment for an inner electrical conduit.

11 Claims, 4 Drawing Figures

ELECTRICAL CONNECTOR

BACKGROUND OF THE INVENTION

The present invention relates generally to the field of electrical connectors and more particularly to electrical connectors that are shielded against the flow of ratio waves and electromagnetic waves. These waves may interfere with the transmission of electrical energy and more particularly electrical signals transmitted through wiring and conduits located within the electrical connector.

More particularly the present invention relates to a generally electrically conductive outer connector element that contains an inner electrically insulated element that is capable of transmitting electrical current and electrical signals through the wires and conduits within the connector while the wires and conduits are shielded from outside radio frequency waves (rf) and electromagnetic (em) waves. The relationship and sliding fit of the between the outer connector element and the inner insulated element.

In the DOT STAR electrical sensor system for stopping a railroad train when a derailment or wheel failure system arises, as best described in U.S. Pat. Nos. 3,929,308; 3,930,629; 4,029,859; issued to John Armstrong et al, there are several instances where it is necessary to transmit electrical signals and electrical current from one movable part of a train wheel or train system, to a final or fixed and stationary part within the train wheel suspension system. In this art a pair of wheel and axle sets combined with side frames and suspension is called a "truck". The "truck" requires a number of electrically powered appliances and other electrically responsive equipment that utilizes transmission of electrical current and electrical signals through one or more electrical conduits or cables.

The "Dot Star" system that is covered by the patents set forth above requires electrical power and transmission of electrical signals in connection with the safety features practiced by the "Dot Star" system.

In experimenting and working with the DOT STAR sensor system the inventors found that there was need for a specially designed electrical connector having an outer fully electrically conductive member with a special designed inner connector element that is electrically insulated from the wires or conduits located within the inner connector element. In such an arrangement the outer member must be fully capable of shielding the inner member from the flow of radio frequency waves and electrically magnetic waves so as not to interfere with electrical signals and electrical input or current carried through the wires and conduits carried within the confines of the insulated member.

In order to solve the problems associated with completely shielding the electrical conduit and electrical wires from radio frequency waves (rf) and electromagnetic waves (em) as well as facing the problems of twisting stress associated with electrical wiring that is fixed on one end, and being subjected to rotation and turning stress on the other end it was necessary for the inventor to design a connector having an outer metallic element that is electrically conductive and an inner protective element that is generally electrically insulated, wherein the electrical wires, conduits and signal transmitting cable means that are to be protected are located inside the inner, insulated flexible connector element.

In the prior art there was no known electrical connector that permitted the rotational flexing of a wire braid conduit at its termination point on the connector and integrally incorporating a 360° degree radio frequency waves (rf) or electromagnetic wave shield termination means in the same connector.

In the prior art devices shielded and insulated connectors terminated in such a way that there was either leakage of RF waves or em wave leakage at that point so that there was interference with any interior electrical signals or electrical current transmissions. Use of the prior art devices caused many DOT STAR failures due to RF or EM interference causing unnecessary and dangerous time consuming train stoppages by transmission of false signals given by leakage or transmission of RF or EM wave signals to the DOT STAR sensor system.

SUMMARY OF THE INVENTION

Accordingly, the present invention provides a fully and completely shielded electrical connector, that has an outer member that is usually electro conductive. This member is a metallic element that is capable of conducting electrical or radio frequency and electromagnetic frequency waves along the outer shielded member combined with an inner insulated member made of a rotatable, soft plastic or rubber material that not only insulates but provides a cushion protective environment for an inner electrical conduit.

The outer connector is preferably a two piece metallic connector that may in one embodiment may be screwed together by the use of conventional screw threads on each of the ends to be connected to each other.

The inner connector may comprise an insulated female element and a co-operating male plug with a special spiral spring used as a electrical contact means.

In addition, both extreme ends of the electrically conductive connector of this invention are both fitted with threads and threaded members that allow termination connection to a conventional hose member wherein a hose member is connected to the threaded ends of the electro conductive member by a 360° metallic swivel connector.

The termination connection at either end of the connector thus provides a continuous electrically conductive path along the connective member onto the threaded member through the metal swivel member and onto and into the hose member by means of a crimped connection between the hose containing a continuous 360° braided metal element, which is common in electrical hose fittings so that a completely electrical connective path is provided along the outer periphery of the connector and a termination screw fitting connection onto and into the conventional hose by means of crimping of the metallic swivel member into the braided metal member in a conventional electrical hose element. In summary the connector of the present invention prevents cable failures caused by the rotational flexing of the cable at the cable termination point on the connector. The connector of this invention permits a degree of rotational flexing of the shielded conduit/cable at the point it joins the connector. This built in flexing capability eliminates the twisting and fatigue at the conduit shield termination.

In addition, any internal wire twisting or conduit twisting that occurs will be spread over a greater length within the conduit and increases the fatigue life of the internal wires or conduits held within the insulated connector element. In such case there is no fixed termination point because the outer conduit is free to rotate and swivel at each end of the connector element around the wiring conduit or wires transmitting the electrical signal or electrical current.

OBJECTS OF THE INVENTION

It is one principal object of the invention to provide an environmentally sealed electrical connector that is shielded against radio frequency waves and electromagnetic waves.

It is another object of the present invention to provide a conductive electric connector that shields current carrying wires or conduits from radio frequency waves and electromagnetic waves within an inner electrically insulated element.

It is one additional important object of the invention to provide an electrical connector with a pair of outer members that are fitted together by screw threads located on each end to be joined.

An additional object is to provide an electrical connector with a pair of outer conductive elements and with suitable inner insulated elements where both are fitted with quick disconnect fittings.

It is a still further important object to provide an inexpensive yet fully environmentally sealed electrical connector that is equiped with both internal and external alignment means and snap on fastener means. As an additional feature the connector is insulated against vibration and shock by a shock absorbing, vibration absorbing element.

It is also one additional object of the invention to provide an electrical connector that is threaded on each end to receive an electrically conductive swivel member that is ring connected to a metallic hose element in such as manner as to conduct radio frequency waves and electromagnetic waves from the connector to a hose member.

It is a still further important object of this invention that electrical connection pins and sockets not protrude from the quick disconnect RF shield connector for maximum environmental protection when disconnected.

DESCRIPTION OF THE PREFERRED EMBODIMENT

Figure 1:
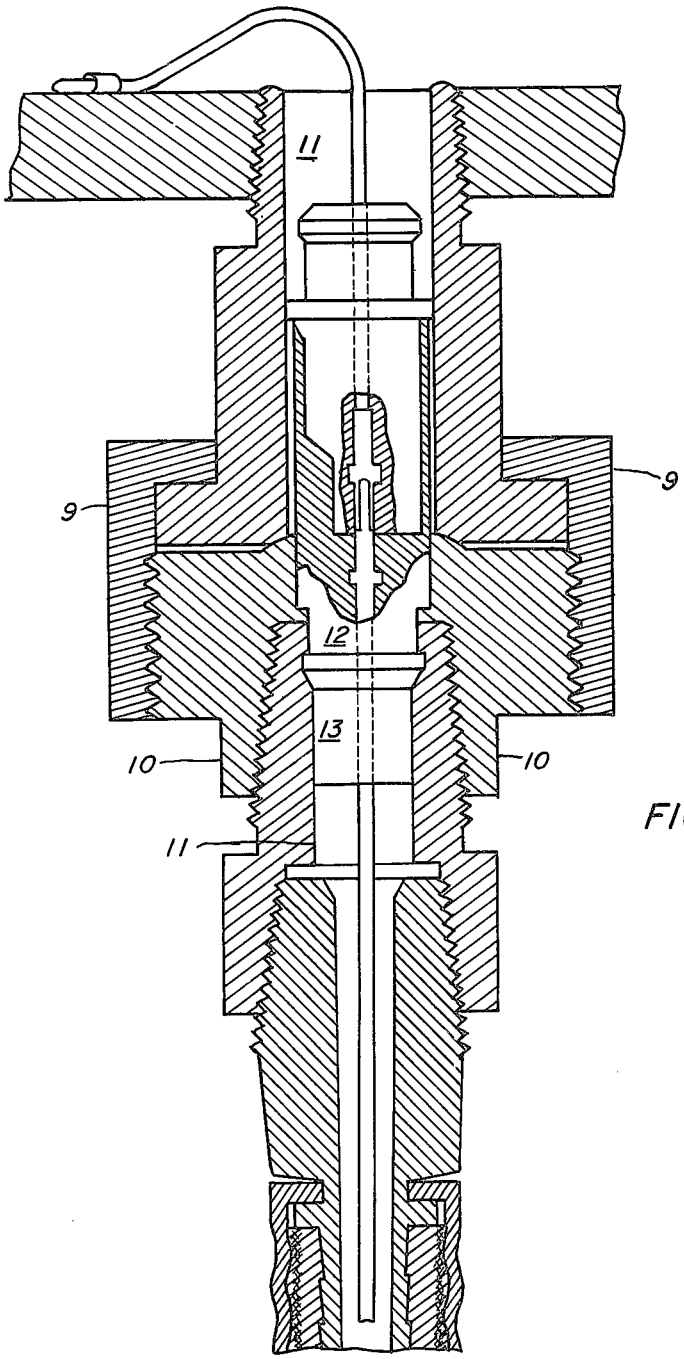
FIG. 1 is a cross sectional cutaway view of the connector of this invention in an assembled position.

Referring now to the drawings wherein like reference characters designate like or corresponding parts throughout, FIG. 1 is a cross sectional view that is a partly cutaway diagram of one embodiment of the electrical connector of this invention illustrates a conduit shielding and termination means.

The outer connector element comprises two sections 9 and 10 that are screw fitted together. The female element 9 and male element 10 may be in the preferred embodiment screw threaded together or in one alternative embodiment snap-fitted together. The female element 9 is further described and limited as follows. One end of outer connector element such as female element 9, may be made of a metal such as aluminum, brass, copper or other suitable metal or metal alloy that may be threaded.

In FIG. 1, the outer metallic connector may be made from a conventional metallic plumbing union connector. A longitudinal opening 11 runs through the center of both the female half 9 and the male half 10 of the outer metallic connector that is electrically conductive. When screw threads are used to join the two outer elements 9 and 10 together the two inner insulated connector elements 12 and 13 are allowed to be slip fitted into longitudinal opening 11 so that each element 12 and 13 may freely rotate. The inner connector elements 12 and 13 may be made from an Amphenol, series 44 connector or other plastic fittings with a longitudinal center line opening that may accommodate conduits, wires or other electrical current carrying means.

Figure 2:
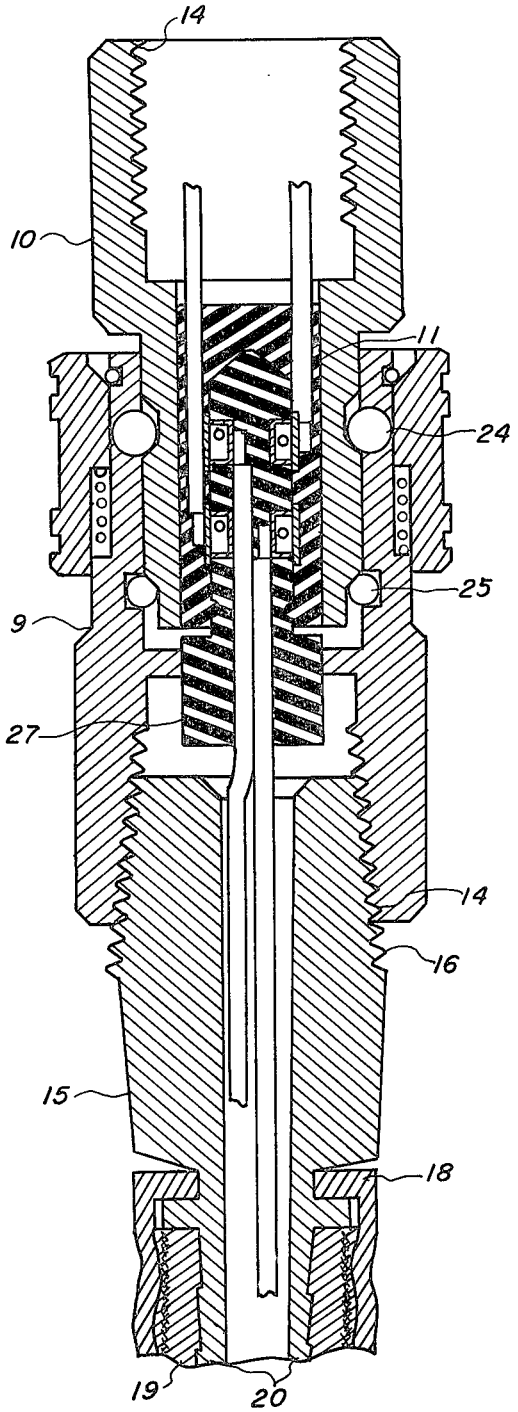
FIG. 2 is a cross sectional view of an alternative embodiment of the invention taken along the longitudinal axis of the connector.

In the alternative embodiment shown in FIG. 2 female element 9 may be snap fitted to male element 10. This disclosure is not intended to imply that the embodiments illustrated in FIGS. 1 and 2 are equivalent and can be used equally in all circumstances.

Figure 3:
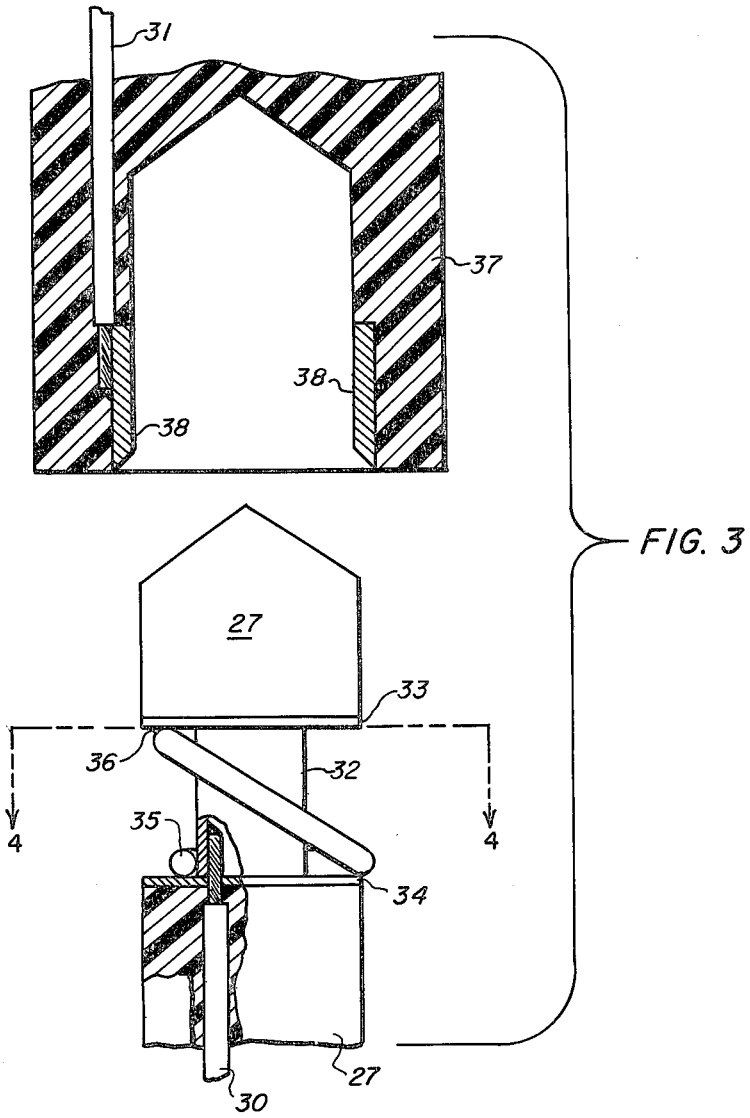
FIG. 3 is a partial cutaway cross sectional view of the details of the plug connections shown in FIG. 2 of this invention in a disengaged position.
Figure 4:
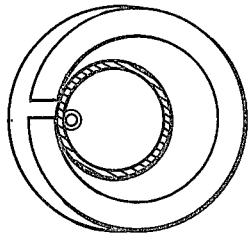
FIG. 4 is a cross sectional view of contact member taken along line 4–4' of FIG. 3.

The embodiment illustrated in FIG. 2 is best used in connection and in combination with the male plug contact 27 best illustrated in FIG. 3. The female element of a standard Hansen air fitting 9 may be snap fitted together by means of a ball connection means with a well known ball detent means with male element 10 and female fastening element 9. Ball detent fastening elements of the type disclosed are well known in the art. In addition, the outer electrically conductive connector in FIG. 2 may be a well known Hansen pneumatic air coupling device, that is commercially available. The Hansen air coupling series ST mechanical air coupling, of the Hansen type used for air handling and transfer is particularly well adapted to be modified by increasing the diameter 11 of the bore to meet the requirements of this invention, particularly when a male plug contact member as illustrated in FIG. 3 is used.

In FIG. 2, when a Hansen ST mechanical air coupling with a longitudinal opening 11 is used, it is then modified so as to vary the inside diameter of the longitudinal opening 11 running through both sections 9 and 10 of the coupling depending upon the size of the two interior connectors desired. The diameter of opening 11 is increased or decreased in both the outer male member 10 and the outer female member 9, so as to accommodate hard rubber or plastic electrical connector elements 12 and 13. The female member of the outer element 10 may be fitted in longitudinal opening 11 with a male plug 27. The rear end 12 of the male plug 27 is located in an opening forward of termination member 15.

The male plug 27 may be made of rubber or plastic or any other non-conductor that insulates against the flow of electrical energy. The increasing or decreasing of the inside diameters of the openings 11, through both the metal coupling elements 9 and 10 will facilitate the placement of the rear of male plug 12 within the opening 11. The male plug 27 co-operates with a corresponding metal ring 38, best shown in FIG. 3. This metal ring is an electrical contact that is connected to conduit 31.

Screw threads 14 are provided at each end of each of the outer coupling elements 10 and 11 to allow connection with a smaller termination means such as connector 15. The termination element, 15 that is a connector may be made of metal or other electrically conductive material. This connector 15 is fitted on one end with male screw threads 16 that are screwably connectable with screw threads 14. At the other end of the termination connector 15 a 360° swivel element 17 is provided. The swivel element 17 may be made of any electrically conductive material. This swivel is a rigid fitting that may be, if electrical conductivity is required or necessary, crimped together with element 18 in such a manner that the outer metallic wall 19 with the inner crimped element 18 impinges through the wall of a standard rubber hose 20 and into the braided metal sheath member 21.

It is through termination element 15 and the screw threaded connection provided between screw threads 14 and 16 that electrical current including radio frequency waves and electromagnetic waves are transmitted along the outer sheath 15, through the swivel element 17 through the outer wall of the hose element 19 by crimped element 18 through the side wall of a standard rubber hose 20. The interior of the hose contains a braided metal sheath 21 or other metallic element within the hose so that electrical conductivity of radio waves, electromagnetic waves or any other electrical wave energy or current can be drained off and transmitted or otherwise transferred from the connector so as not to allow rf or em waves to interfere with the electrical signals in wires 22 and 23 that run through the center of the inner insulated electrical connector and are transmitting electrical signals or electrical current from one point to another point in the Dot Star sensor system used in the Dot Star train wheel systems.

In a conventional Hansen air connector a plurality of sleeve lock balls 24 are used to facilitate the movement of the male and female Hansen connectors together.

An additional ball detent 25 may be utilized to aid in the alignment and locking of the male and female electrically conductive coupling. This ball detent may be spring loaded or fixed as is conventionally practiced in the industry.

In FIG. 3 the male plug 27 that may be fabricated from an insulator material, i.e., a thermoset resin or other plastic such as polypropylene or a phenolic resin.

In one preferred embodiment electrical contact 30 is welded, soldered or otherwise connected to a metal spool with a reduced diameter 32 and an upper conductor plate 33 and a lower conductor plate 34, each said plate being at opposite ends of the center section of the spool 32.

An electrical contact member, made of a single revolution of a coil spring 35 is secured at its upper end 36 to upper plate 33 by welding or mechanical attachment while the lower end 37 is allowed free movement. The outer diameter of the spring 35 that is off center of the male plug (non concentric) is slightly greater than the diameter of circular plates 33 and 34. The greater diameter yields a tension that is important to maintaining good electrical contact.

The male plug 27 fits into a female receiving insulated connector 37 that is fitted with a circular metallic band contact 38. Because of the tension in the outer circumference of spring contact 35 it may be contiguous with a number of points around the inside surface of circular band 38. A number of bands 38 located along the length of receptacle element 37 may make contact with its own separate spring contact 35 that carries current from a separate electrical conduit 30.

In an alternative manufacture technique the outer electrically conductive coupling 9 and 10 may be made from metal alloy or heavy plastic with metal inbedded therein in such a way that the interior elements 12 and 13 usually made of an electrically insulated material such as phenolic plastics, rubber, teflon or polyethylene or polyprolene may be laminated together in the manufacturing process so as to be one essential element. In such cases it is likely the manufacturing of the one connector element with an outer metal sheath 9 and 10 and inner electrically insulated element 13 may be cheaper to manufacture and may form a more efficient and stronger connector element having a much greater life and requiring less labor for assembly of the final electrical connector.

Obviously, numerous modifications and variations of the present invention are possible in light of the above teaching. It is therefore to be understood that within the scope of the appended claims the invention may be practiced otherwise than as specifically described herein.

What is claimed and desired to be secured by Letters Patent of the United States is:

1. An electric connector comprising in combination a multielement housing containing electrical conduit where the housing is shielded from electrical interference by electrically insulated shielding means comprising:

(a) two coacting outer connector sections that are generally electrically conductive and (b) means to connect one outer connector section to the other outer connector section by screw threads located on each section and each such section having one termination point and wherein swivel means are provided at one termination point that will withstand rotational flexing of electrical conduits, (c) two coacting inner connector sections that are within the two outer connector sections and in contact with the said outer connector sections and both inner connector sections are generally electrically insulated and (d) means to slip fit one inner connector section into the other inner connector section where (e) one inner connector is fitted with a female receptacle with at least one electrical contact and the other inner connector is fitted with a male plug fitted with an electrical contact and an electrical conduit conected thereto and wherein one outer connector section is joined to one inner connector section by slip fastening the two inner connector sections together and each of said inner connector sections is a freely rotating cylindrical insulated connector element that functions to rotate 360° with respect to its own outer connector the two inner connector sections are joined by slip fitting the first inner connector into a second inner connector section.

2. The electrical connector of claim 1 wherein the male plug member is fitted with a segment of spiral spring contact that is connected to an electrical conduit.

3. The connector of claim 2 wherein the spiral spring contact fits into a metallic band electrical contact that is connected to an electrical conduit.

4. The electrical connector of claim 1 wherein the swivel means is fastened to a hose with an inner metallic section that allows bleed off of EM and RF waves that flow along the outer connector sections.

5. The electrical connector of claim 4 wherein the swivel element is a metallic material and the connection thereof to the hose is a metallic material that is connected to the inner metallic section by a crimped connection.

6. The electrical connector of claim 4 wherein the metallic section comprises a 360° shield against radio frequency waves and electromagnetic waves.

7. The connector of claim 1 where one outer metallic connector section terminates in an electrically conductive swivel element.

8. The connector of claim 7 where the swivel element is crimped to a metallic sheath member.

9. The electric connector of claim 1 wherein the two coacting inner connector sections that are generally electrically insulated are in contact with the said outer connector sections and where the first said inner insulated connector section forms a male plug wherein the female receptacle is fitted with a circular metallic band contact and the male plug is fitted with a corresponding metallic contact spool that fits into the circular band contact.

10. The electrical connector of claim 9 wherein the circular band is secured inside the bore of the insulated inner female connector and is in electrical contact with an electrical conduit.

11. The electrical connector of claim 9 wherein one outer connector is connected to the mating outer connector section by a slip fitting ball detent connection.

* * * * *